US005184150A

United States Patent [19]

Sugimoto

[11] Patent Number: 5,184,150

[45] Date of Patent: Feb. 2, 1993

[54] THERMAL PRINTER FOR PROVIDING PRINTED CHARACTERS WITH A UNIFORM DENSITY

[75] Inventor: Yukihiko Sugimoto, Kashihara, Japan

[73] Assignee: Sharp Kabushiki Kaisha, Osaka, Japan

[21] Appl. No.: 562,193

[22] Filed: Aug. 3, 1990

[30] Foreign Application Priority Data

Aug. 7, 1989 [JP] Japan ..... 1-204276

[51] Int. Cl.[5] ..... B41J 2/38; B41J 2/365

[52] U.S. Cl. ..... 346/76 PH

[58] Field of Search ..... 346/76 PH, 108, 1.1; 400/120

[56] References Cited

U.S. PATENT DOCUMENTS

| | | | |
|---|---|---|---|
| 4,364,063 | 12/1982 | Anno et al. | 346/76 PH |
| 4,524,368 | 6/1985 | Inui et al. | 346/76 PH |
| 4,528,572 | 7/1985 | Sasaki et al. | 346/76 PH |
| 4,574,293 | 4/1986 | Inui et al. | 346/76 PH |
| 4,843,409 | 6/1989 | Matsuzaki | 346/76 PH |
| 4,845,514 | 7/1989 | Mitsushima et al. | 346/76 PH |
| 4,876,559 | 10/1989 | Nishikawa | 346/76 PH |
| 4,912,485 | 3/1990 | Minowa | 346/76 PH |

FOREIGN PATENT DOCUMENTS

| | | | |
|---|---|---|---|
| 0115841 | 8/1984 | European Pat. Off. . | |
| 0194676 | 9/1986 | European Pat. Off. . | |
| 0304916 | 3/1989 | European Pat. Off. . | |
| 62-55163 | 3/1987 | Japan . | |
| 62-55164 | 3/1987 | Japan | 346/76 PH |
| 62-64572 | 3/1987 | Japan | 346/76 PH |

*Primary Examiner*—Benjamin R. Fuller
*Assistant Examiner*—N. Le
*Attorney, Agent, or Firm*—David G. Conlin; Robert F. O'Connell

[57] ABSTRACT

The present thermal printer provides a high-speed printing table and a low-speed printing table in addition to the thermal printing head containing dot heating elements and a switch for switching the printing mode. The high-speed printing table contains pulse widths matching to the printing hysteresis of the current to the Nth previous bit and the low-speed printing table contains pulse widths matching to the printing hysteresis of the current to the Mth previous bit, the M being smaller than the N. The printer further provides a printing control circuit and a central processing unit which operate cooperatively to determine the printing hysteresis of the current to the Nth or Mth previous bit, access to the necessary address locations for the pulse widths according to the printing hysteresis, and allow the current to pass through each necessary dot heating element for the time defined by the accessed pulse width.

5 Claims, 3 Drawing Sheets

Fig. 1 PRIOR ART
| 4 | 3 | 2 | 1 | CURRENT | PULSE WIDTH |
|---|---|---|---|---|---|
| × | × | × | × | ○ | T5 |
| ○ | × | × | × | ○ | T4 |
| — | ○ | × | × | ○ | T3 |
| — | — | ○ | × | ○ | T2 |
| — | — | — | ○ | ○ | T1 |
Fig. 2 PRIOR ART
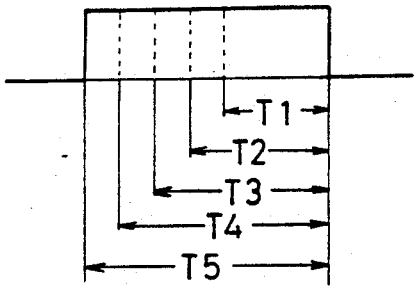
Fig. 3
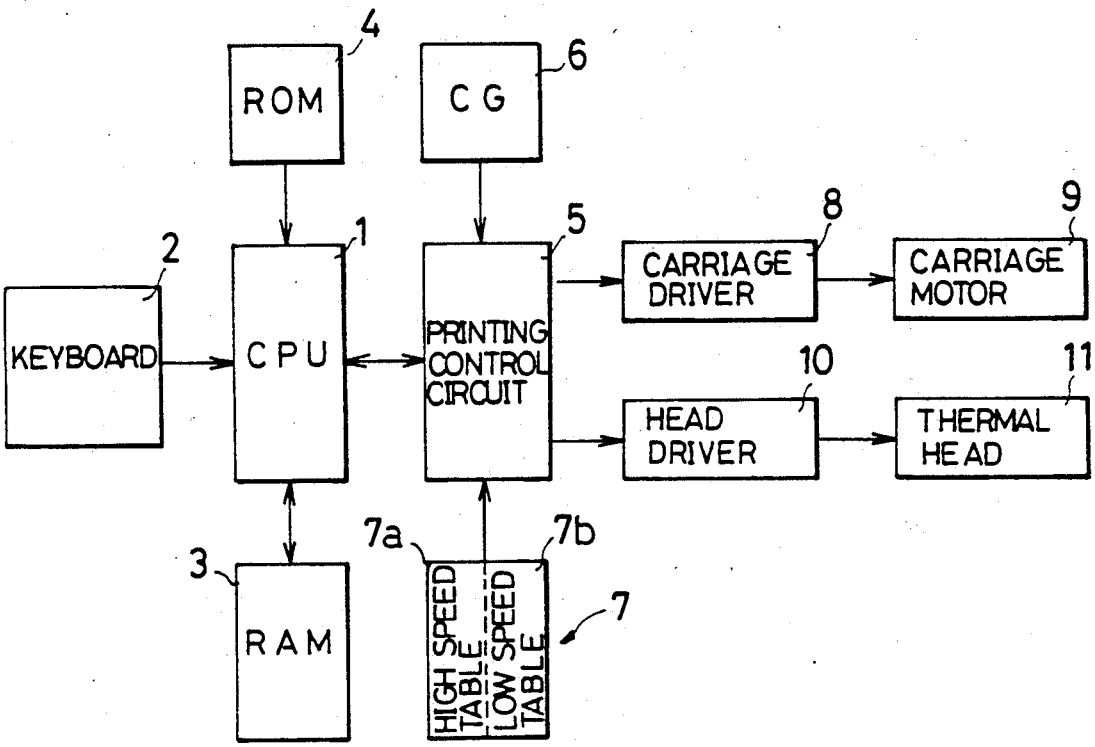

Fig. 5
| N | N-1 | N-2 | ------ | 3 | 2 | 1 | CURRENT | PULSE WIDTH |
|---|---|---|---|---|---|---|---|---|
| ○ | × | × | ------ | × | × | × | ○ | $T_1$+ ------ + $T_N$ |
| — | ○ | × | ------ | × | × | × | ○ | $T_1$+ ------ +$T_{N-1}$ |
| — | — | ○ | ------ | × | × | × | ○ | $T_1$ + ------ +$T_{N-2}$ |
| ⋮ | ⋮ | ⋮ | | ⋮ | ⋮ | ⋮ | ⋮ | ⋮ |
| — | — | — | ------ | ○ | × | × | ○ | $T_1 + T_2 + T_3$ |
| — | — | — | ------ | — | ○ | × | ○ | $T_1 + T_2$ |
| — | — | — | ------ | — | — | ○ | ○ | $T_1$ |
Fig. 6
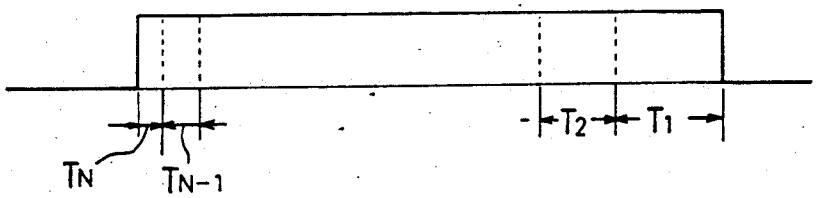
Fig. 7
| M | M-1 | M-2 | ------ | 3 | 2 | 1 | CURRENT | PULSE WIDTH |
|---|---|---|---|---|---|---|---|---|
| × | × | × | ------ | × | × | × | ○ | $t_1$ + ------ + $t_M$ |
| — | ○ | × | ------ | × | × | × | ○ | $t_1$+ ---- +$t_{M-1}$ |
| — | — | ○ | ------ | × | × | × | ○ | $t_1$ + ---- + $t_{M-2}$ |
| ⋮ | ⋮ | ⋮ | | ⋮ | ⋮ | ⋮ | ⋮ | ⋮ |
| — | — | — | ------ | ○ | × | × | ○ | $t_1 + t_2 + t_3$ |
| — | — | — | ------ | — | ○ | × | ○ | $t_1 + t_2$ |
| — | — | — | ------ | — | — | ○ | ○ | $t_1$ |
Fig. 8
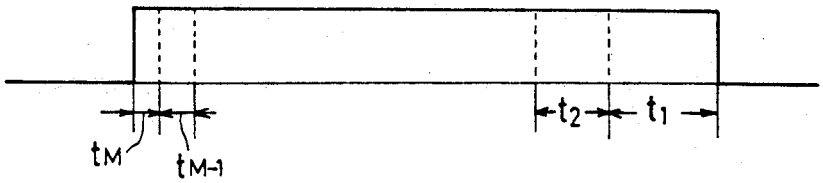

THERMAL PRINTER FOR PROVIDING PRINTED CHARACTERS WITH A UNIFORM DENSITY

BACKGROUND OF THE INVENTION

1. Field of the Invention

The present invention relates to a thermal printer, and more particularly to the thermal printer which has at least two printing speed modes, that is, a high-speed mode and a low-speed mode to be selectively switched and is capable of variably controlling a time when current flows through each necessary dot heating element contained in a thermal printing head.

2. Description of the Related Art

In general, the normal thermal printer includes a thermal printing head containing dot heating elements disposed in a vertical line. For printing one character, these dot heating elements are selectively heated to form a character as the thermal printing head travels in the printing direction at a predetermined pitch. As such, one character is printed by the dots for character each time the thermal printing head is travelled by the predetermined number of dots. According to this method, some character patterns may allow the same dot heating elements to be kept heating. The surfaces of these heating elements are heated up too much because of the condensed heat thereon. It results in disadvantageously causing the printed characters to have variable density, remarkably lowering character quality and degrading the dot heating elements.

To overcome the disadvantage, the present applicant knows the related thermal printer is designed to continuously manage printing hysteresis and variably control the time when current flows through each necessary dot heating element according to the printing hysteresis. FIG. 1 is a chart illustrating a table for managing the printing hysteresis of the current bit to the fourth previous bit, wherein O denotes printing, X denotes non-printing, and — denotes "Don't Care". FIG. 2 is a chart illustrating pulse widths T1 to T5 defined according to the printing hysteresis illustrated in FIG. 1. It is clearly understood from these charts that as the previous printing is further than the current printing, the larger pulse width is used for the current printing. That is, the larger pulse width can expand the time when current flows through each necessary dot heating element in order to conform with the fact that the longer time interval from the current printing to the next results in the longer cooling time of the dot heating elements. It results in achieving substantially uniform density on printed characters.

In general this kind of thermal printer is designed to switch the printing speed to a high-speed printinq mode or a low-speed mode. The foregoing table corresponds with the high-speed printing mode at which the dot heating elements do not have enough cooling time because of a shorter printing period. In the low-speed printing mode, however, the dot heating elements operated three bits previous have already cooled down because of the foregoing longer printing period. It is, therefore, unnecessary to manage the printing hysteresis before the third previous bit, though, the printing is operated on the table for the high-speed printing mode. It means that when the printing is done before the third previous bit, the time when current flows through each necessary dot heating element is made shorter than a proper time, resulting in making the printed characters thinner in density. Conversely, if the thermal printer provides the table corresponding with the low-speed printing mode, in the high-speed printing mode, excessive energy is applied on the dot heating elements, thereby rapidly degrading the thermal printing head and reducing the life of the head.

SUMMARY OF THE INVENTION

It is therefore an object of the present invention to provide a thermal printer which is capable of constantly applying proper energy to the dot heating elements for providing printed characters with uniform density in case of selecting any one of the high-speed printing mode or the low-speed printing mode.

In carrying out the object in a preferred mode, the present invention is achieved by a thermal printer including a thermal printing head provided with dot heating elements and a switch for switching the printing mode from a high-speed mode to a low-speed one or vice versa, which includes a high-speed printing table containing pulse widths respectively for the printing hysteresis of the current bit to the N-th previous bit, a low-speed printing table containing pulse widths respectively for the printing hysteresis of the current bit to the M-th previous bit, the M being smaller than said N, and means for selecting any one of both two tables in response to the selected printing speed mode, determining the printing hysteresis of the current bit to the N-th bit or M-th previous bit, having access to each necessary address location for the pulse width on the selected table on the basis of the printing hysteresis, and adjusting the time when current flows through each necessary dot heating element to the time defined by the pulse width contained in the selected table.

For the high-speed printing mode, the present thermal printer operates to select the mode, determine the printing hysteresis of the current bit to the N-th previous bit, have access to the time-width address location on the high-speed printing table according to the printing hysteresis, and pass current through each necessary dot heating element contained in the thermal printing head for a time defined by the accessed time width.

Likewise, for the low-speed printing mode, the present thermal printer operates to select the mode, determine the printing hysteresis of the current bit to the M-th previous bit, have access to the time-width address location on the low-speed printing table according to the printing hysteresis, and pass current through each necessary dot heating element contained in the thermal printing head for a time defined by the accessed pulse width.

As mentioned above, the thermal printer of this invention provides the high-speed printing table and the low-speed printing table which respectively contain the printing hysteresis and the pulse width matched to the printing hysteresis of the high-speed or the low-speed printing mode. The printer operates to select the proper table for the printing speed mode. Hence, it can constantly apply proper energy to the dot heating elements contained in the printing head in a manner to adapt to the various conditions so that it can achieve uniform density for printed characters. Further, the printer can keep the life of the thermal printing head as long as possible, because it serves to positively refrain application of excessive energy which would otherwise degrade the thermal printing head overly.

Further objects and advantages of the present invention will be apparent from the following description of the preferred embodiments of the invention as illustrated in the accompanying drawings.

BRIEF DESCRIPTION OF THE DRAWINGS

FIG. 1 is a chart illustrating a table used in a related art;

FIG. 2 is a chart illustrating pulse widths contained in the table used in the related art;

FIG. 3 is a block diagram showing a thermal printer according to an embodiment of the present invention;

FIG. 5 is a chart illustrating a high-speed printing table;

FIG. 6 is a chart illustrating pulse widths contained in the high-speed printing table;

FIG. 7 is a chart illustrating a low-speed printing table; and

FIG. 8 is a chart illustrating pulse widths contained in the low-speed printing table.

DESCRIPTION OF THE PREFERRED EMBODIMENT

Figure 4:
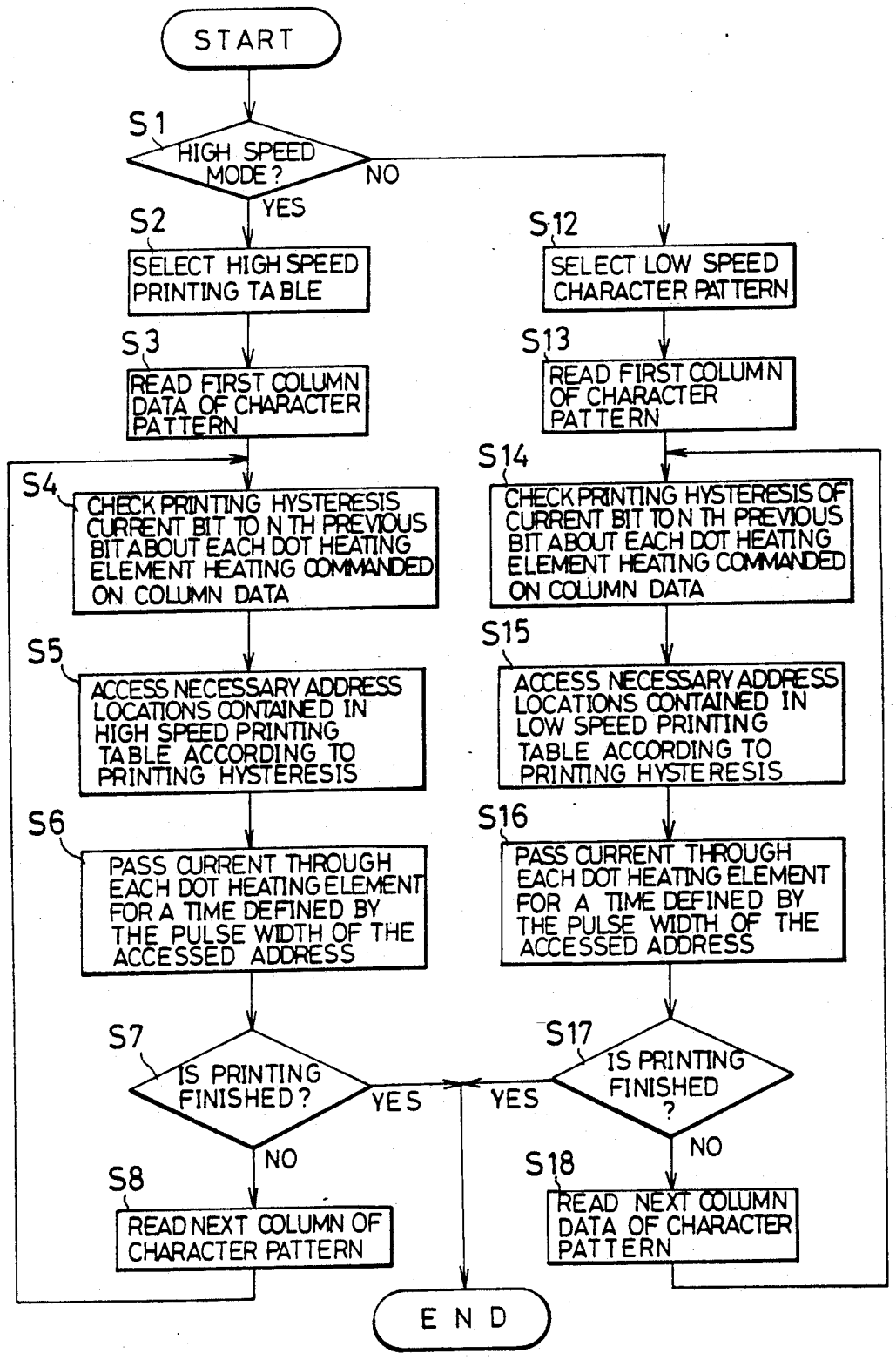
FIG. 4 is a flowchart showing the operation of the thermal printer according to the embodiment.

Hereinafter, a description will be directed to one preferred embodiment of the invention with reference to the drawings.

At first, the description is directed to the arrangement of a thermal printer related to the embodiment with reference to FIG. 3.1 denotes a central processing unit (abbreviated as a CPU), which serves to control the printer in accordance with a program stored in a read-only memory 4. The CPU 1 serves to process text data entered on a keyboard 2 and send the result to a random access memory (abbreviated as a RAM) 3. The RAM 3 temporarily stores the processed text data. Then, in response to a printing command entered on the keyboard 2, the CPU 1 reads the text data from the RAM 3 to a printing control circuit 5. The printing control circuit 5 reads each character contained in the text data, that is, a character pattern at a predetermined row and column from a character generator 6 and then continuously outputs each column data of the character pattern to a head driver 10. The head driver 10 controls a thermal head providing dot heating elements so that it may selectively pass current through the dot heating elements corresponding to the column data. Each time each dot heating element finishes its selective heating, the CPU 1 sends out a motor-driving pulse to a carriage driver 8 through the printing control circuit 5 so that the carriage driver 8 can operate a carriage motor 9 one pitch by one pitch, thereby travelling the thermal head 11 in the printing direction one pitch by one pitch. 7 denotes a table memory for saving a high-speed printing table 7*a* and a low-speed printing table 7*b*. One of these tables is selected in response to the specification done on the keyboard 2. The printing control circuit 5 serves to have access to the corresponding address locations contained in the table 7*a* or 7*b*. The address locations to be accessed correspond to the printing hysteresis of the current bit to the N-th or M-th previous bit and concerns with the pulse widths. Then, the printing control circuit 5 serves to pass current through each dot heating element for the time defined by the pulse width of the accessed address location.

FIG. 5 is a chart illustrating the high-speed printing table 7*a* for managing the printing hysteresis of the current bit to the N-th previous bit. FIG. 7 is a chart illustrating the low-speed printing table 7*b* for managing the printing hysteresis of the current bit to the M-th previous bit. In both tables, O denotes printing, X denotes non-printing, and —denotes "Don't Care". The pulse widths defined for the printing, hysteresis is illustrated in FIGS. 6 and 8. For the high-speed printing table 7*a*, the previous bit from the current bit matches to a pulse width $T_1$, the second previous bit from the current bit matches to a pulse Width $T_1+T_2$, the third previous bit from the current bit matches to a pulse width $T_1+T_2+T_3$, . . . the (N−2)th previous bit from the current bit matches to a pulse width $T_1+\ldots+T_{N-2}$, the (N−1)th previous bit from the current bit matches to a pulse width $T_1+\ldots+T_{N-1}$, and the N previous bit from the current bit matches to a pulse width $T_1+\ldots+T_N$. These pulse widths individually matched to the previous bits are made smaller as the bit are more previous from the current bit. These previous bit number N and their corresponding pulse widths are computed from each printing period defined in the high-speed printing mode. For the low-speed printing table 7*b*, the arrangement is analogous to that of the table 7*a* except that the pulse width is represented by t and the most previous bit to be managed is M. N for the high-speed printing mode is larger than M for the low-speed printing mode, because the numbers N and M are computed from the printing period and in the high-speed printing mode, the printing period, that is, a head-cooling period is shorter than that in the low-speed printing mode.

In operation the thermal printer operates on the flow shown in FIG. 4. In response to a printing command entered on the keyboard 2, the printing control circuit 5 determines if the high-speed printing mode is specified (step S1). If it is specified, the circuit 5 selects the high-speed printinq table 7*a* from the table memory 7 (step S2). Then, the circuit 5 reads the first column data of the character patter for the printing character from the character generator 6 (step S3). This first column data corresponds to the heating-commanded dot heating elements contained in the thermal printing head 11. Next, the circuit 5 checks the printing hysteresis of the current bit to the Nth previous bit about th heating-commanded dot heating elements in the first column data (step S4).

The circuit 5 has access to the address locations for pulse widths on the high-speed printing table 7*a* according to the checked printing hysteresis (step S5). It controls the head driver 10 to allow the current to pass through each heating-commanded dot heating element for the time defined by the pulse width of the accessed address location (step S6). Finally, the thermal head 11 serves to thermally record the dots.

After the thermal recording, it is determined if all the characters to be printed are printed (step S7). If not, the printing control circuit 5 reads the next column data of the character pattern (step S8). Then, the process jumps to the step S4, where the operation is executed from the steps S4 to S8 until the printing is finished.

If, on the other hand, the low-speed printing mode is specified, like the foregoing high-speed printing mode, the printing control circuit 5 selects the low-speed printing table 7*b* from the table memory 7 (step S12) and then reads the first column data of the character pattern for the printing character from the character generator 6 (step S13). This first column data corresponds to the heating-commanded dot heating elements contained in the thermal printing head 11. Next, the circuit 5 checks the printing current bit to the M previous bit about the heating-commanded dot heating elements of the first column data (step S14).

The circuit 5 has access to the address locations for pulse widths on the low-speed printing table *7b* according to the checked printing hysteresis (step S15). It controls the head driver 10 to allow the current to pass through each heating-commanded dot heating element for the time defined by the pulse width of the accessed address location (step S16). Finally, the thermal head 11 serves to thermally record the dots.

After the thermal recording, it is determined if all the characters to be printed are printed (step S17). If not, the printing control circuit 5 reads the next column data of the character pattern (step S18). Then, the process jumps to the step S4, where the operation is executed from the steps S4 to S8 until the printing is finished.

As described above, the thermal printer of the present invention provides the high-speed printing table and the low-speed printing table respectively having the printing hysteresis and the pulse width matching to the high-speed and low-speed mode printing periods, so that it can select one of these tables according to the printing speed mode. Hence, the printer is capable of constantly applying proper energy to each dot heating element of the printing head in a manner to adapt to the various conditions, resulting in being able to print high-quality, that is, uniform-density characters as well as positively refrain application of excessive energy which would otherwise degrade the thermal printing head overly.

Manly widely different embodiments of the present invention may be constructed without departing from the spirit and scope of the present invention. It should be understood that the present invention is not limited to the specific embodiments described in the specification, except as defined in the appended claims.

What is claimed is:

1. A thermal printer for providing printed characters with a uniform density and for constantly applying proper energy to dot heating elements either in a high-speed printing mode or in a low-speed printing mode, said thermal printer comprising:

a high-speed printing table containing defined pulse widths respectively for a printing hysteresis of a current bit to an N-th previous bit, wherein N represents a positive integer;

a low-speed printing table containing defined pulse widths respectively for a printing hysteresis of a current bit to an M-th previous bit, wherein M represents a positive integer which is smaller than said N;

means connected to both said high-speed printing table and said low-speed printing table for selecting a printing mode of said thermal printer;

means connected to said mode selecting means for selecting either said high-speed printing table or said low-speed printing table in response to a selected printing speed mode in accordance with said printing mode selecting means;

means for determining a printing hysteresis of a current bit to said N-th or said M-th previous bit;

means for selecting a pulse width at an address location on either said high-speed printing table or said low-speed printing table as selected by said table selecting means, said pulse width being selected in accordance with the printing hysteresis of said current bit of said selected printing table; and means for adjusting a time when a current flows through each of necessary dot heating elements to a time defined by said selected pulse width on either said high-speed printing table or said low-speed printing table as selected by said table selecting means.

2. A thermal printer according to claim 1, wherein said table selecting means and said determining means consist of a central processing unit, and said pulse width selecting means and said adjusting means consist of a printing control circuit.

3. A thermal printer according to claim 2, wherein said thermal printer further comprises a ready-only memory connected to said central processing unit for saving a program so as to control said thermal printer and a random access memory connected to said central processing unit for temporarily storing processed text data.

4. A thermal printer according to claim 3, wherein said thermal printer further comprises a character generator connected to said printing control circuit for generating a character pattern, a head driver connected to said printing control circuit for controlling a thermal head, a carriage motor coupled to said printing control circuit for moving said thermal head in a printing direction, and a carriage driver connected to both of said printing control circuit and said carriage motor for operating said carriage motor.

5. A thermal printer according to claim 1, wherein both of said high-speed printing table and said low-speed printing table are so arranged that said pulse widths contained therein become smaller as a bit is more previously located from said current bit.

* * * * *